United States Patent [19]

Schleich et al.

[11] Patent Number: 4,566,426

[45] Date of Patent: Jan. 28, 1986

[54] METHOD AND DEVICE FOR SHARPENING A GRINDING DISK

[75] Inventors: Heinrich Schleich, Stolberg; Kemal Yegenoglu, Aachen, both of Fed. Rep. of Germany

[73] Assignee: Ernst Winter & Sohn (GmbH & Co), Hamburg, Fed. Rep. of Germany

[21] Appl. No.: 513,976

[22] Filed: Jul. 14, 1983

[30] Foreign Application Priority Data

Sep. 10, 1982 [DE] Fed. Rep. of Germany ..... 3233609

[51] Int. Cl.[4] ..... B24B 53/04

[52] U.S. Cl. ..... 125/11 R; 125/11 CD; 51/325; 51/165.77; 51/165.9

[58] Field of Search ..... 125/11 R, 11 CD; 51/165.77, 165.87, 325, 165.9

[56] References Cited

U.S. PATENT DOCUMENTS

| | | | |
|---|---|---|---|
| 2,443,789 | 6/1948 | Flygare | 125/11 CD |
| 2,446,105 | 7/1948 | Polk | 125/11 CD |
| 3,037,330 | 6/1962 | Weigand | 125/11 CD |
| 4,118,900 | 10/1978 | Moritomo | 51/165.77 |
| 4,452,223 | 6/1984 | Shank | 125/11 R |

*Primary Examiner*—Harold D. Whitehead

*Attorney, Agent, or Firm*—Michael J. Striker

[57] ABSTRACT

A method and device for sharpening and scouring a grinding disk having a grinding medium, in which a feeding velocity of a sharpening block is adjusted by a first drive means connected to the sharpening block for sharpening the disk and a feeding force applied to the sharpening block is adjusted by a second drive coupled to the first drive whereby the adjustable feeding velocity is reduced when the feeding force reaches its maximum allowable value.

6 Claims, 3 Drawing Figures

METHOD AND DEVICE FOR SHARPENING A GRINDING DISK

BACKGROUND OF THE INVENTION

The present invention relates to a method and device for sharpening and scouring grinding disks having a grinding medium such as diamond or cube-crystalline borine nitride.

Conventional methods of sharpening grinding disks of the type under discussion are carried out by means of a sharpening block applied to the outer cylindrical surface of the grinding disk.

Grinding disks with diamond and cube-crystalline borine nitride as a grinding medium are usually utilized for machining many different materials, particularly very hard iron and non-iron materials, due to the high wear resistance and some other technological advantages of the grinding disks of this type.

Principal problems occurred in the utilization of such grinding disks have been connected with high technical and financial expenses, particularly in profiling and sharpening these grinding disks. This takes place especially with profiled grinding disks in which wear can not be compensated by adjusting of the machine and therefore causes errors in the formation of the workpiece. These grinding disks must be then reprofiled in predetermined operation cycles.

For profiling diamond-and-borine-nitride grinding disks are available at the present time a number of profiling methods. A necessary profiling method is usually selected depending on the grain material utilized, such as diamond or borine nitride and also on a binder used and in dependence upon a profile of the grinding disk.

Many profiling methods are known, particularly those which are carried out with diamond rolls, diamond strips or diamond bands or diamond blocks or similar profiling tools having diamond pieces. Grinding disks also formed of rotatable profiling tools from silicon carbide or corundum have been also utilized for polishing the outer surface of the grinding disks after the latter have been profiled, particularly when a high cutting range was required.

The grain distribution in the material of the disk through the binder is too small so that an insufficient space for carrying chips away and for supplying a cooling lubricant to the disk is available. The grinding disk must in addition, in many instances, be further resharpened after being sharpened preliminarily. This process which is accompanied with tearing up, roughening or free drawing of the disk surface causes a reset of the binder with respect to the grains of the grinding medium so that no or a very small quantity of diamond or borine nitride grains would break and the contour of the grinding disk would not change.

Sharpening with a sharpening block of corundum and/or silicon carbide with a ceramic or bakelitic binder has been found particularly advantageous. The sharpening block is applied to the grinding disk by running about the disk (deep grinding) or by immersion (dipping grinding).

The utilization of conventional methods has, however, some problems. These have been caused by relatively high feeding velocities of the sharpening stones, which occur at the beginning of the sharpening process. Relatively large forces have been also exerted on the sharpening block at the beginning of the process. These large forces normally lead to substantial wear of the fine profile. On the other hand, it has been desired to obtain chip chambers of certain volumes which would be optimal for the further use of the grinding disks.

SUMMARY OF THE INVENTION

It is an object of the present invention to provide a method of sharpening a grinding disk with a sharpening block, which method substantially reduces expenses required for a material of the sharpening block and significantly shortens the time period of sharpening.

It is a further object of this invention to provide a method of sharpening grinding disks in which given chip spaces between the diamond-or borine nitride grains of the grinding disk are reproducibly generated without, however, damaging the grinding disk due to high forces exerted between the sharpening block and the grinding disk and without unfavorable mechanical or thermal influencing the process.

It is still another object of the invention to provide a method with improved technological and commercial characteristics.

It is yet another object of the invention to provide a device for carrying out the method according to the invention.

These and other objects of the invention are attained by a method of sharpening and scouring a grinding disk of a grinding medium including diamond-or cube-crystalline borine nitride grains by means of a sharpening block operated in contact with the grinding disk and in which the sharpening block is applied to the grinding disk during sharpening with an adjustable feeding velicity and an adjustable feeding force, the method comprising the steps of preliminarily adjusting the feeding velocity of the sharpening block and reducing the feeding velocity when the feeding force reaches its maximum allowable value so that the adjustable maximum force (Fmax) applied to the sharpening block is not exceeded.

According to a further feature of the invention the feeding velocity, after it has been reduced, is kept in accordance with the maximum value of the adjustable feeding force and is brought to a preliminarily adjustable nominal value and is maintained constant independently from the feeding force when the value of the actual feeding force is below the maximum value of the feeding force.

The sharpening with the sharpening block applied with the constant feeding force to the grinding disk is advantageous in that the overloading of the grains of the grinding disk, due to high forces at the beginning of the process, is prevented from the occurrence because the feeding velocity is adjusted to the adjustable feeding force at each moment during the operation. The adjustment of the feeding force can be achieved, for example by a hydraulic or pneumatic system or by weight means. Due to the application of the optimal feeding force, the roughness of the grinding disk, such as that caused by grinding by spiral drills, can be accommodated, and high feeding forces will cause the high roughness of the grinding disk, which is required for grinding with high cutting loads.

After a selection of the value of the feeding force a sharpening for long time periods is necessary when a very smooth grinding disk is to be profiled. In this case the sharpening block is supported against the grinding coating without affecting an abrasive. For shortening and reproducing the sharpening process the grinding disk should be profiled so that a sufficient roughness of the grinding coating due to immediate wear of the sharpening block would be warranted.

It should be noted that the non-satisfactory feeding is disadvantageous. The adjustable feeding force acts only over a regulated width of the grinding disk, and according to the chippability of the binder, a cooling lubricant used and a feeding velocity of the sharpening block; the above conditions define the size of chip spaces formed in the process. Relation between the feeding force applied to the sharpening block and the chip spaces generated in the process can be determined only in individual cases and very often it has been difficult and troublesome to define that relation. This has been found particularly in the instances when different profiling grinding disks have been utilized. The above noted relation contradicts in principle to an optimal process because a relatively short sharpening time period requires a high sharpening force at the beginning of the process and the high sharpening force can subsequently cause a non-permissible high feeding velocity.

A sharpening with a constant feeding velocity ensures, independently from the limiting conditions, that the ship space in the grinding disk is adjusted in accordance with the feeding velocity. Thereby non-allowable high forces between the sharpening block and the grinding disk at the beginning phase of the sharpening process can not occur. The danger of overloading of the sharpening block, when a very smooth grinding disk is profiled, is therefore avoided.

Depending on the shape of the grinding disk and the size of the chip space produced in the process it is possible that neither sharpening with the constant feeding force nor sharpening with the constant feeding velocity can be obtained in one course of the sharpening process.

Suprisingly one can achieve with the sharpening method according to the invention, very satisfactory results in sharpening and with a very short time period, on the one hand, by applying a constant feeding velocity to the sharpening block at the end phase of the process, particularly with the grinding disks which are difficult to sharpen, and, on the other hand, by applying an adjustable feeding force at the beginning of the process, without unfavorably affecting the quality of the grinding disk.

When the feeding velocity is first limited to a preliminarily adjusted force the following should be taken into consideration.

If chip spaces between the grinding grains become open the forces exerted on the disk under steady feeding velocity will decrease as the friction surface is reduced and the chips will be withdrawn from the gap between the grinding disk and the sharpening block. If the feeding force is now limited to a stable, constant value the feeding velocity will increase continuously depending on the further formation or increase of the chip spaces between the grains. The chip spaces will not further increase under a lower feeding velocity because the chip's removal is so large at the sharpening block that it will take place through the chip spaces. If small chip spaces exist between the grains will the feeding velocity increase but the predetermined feeding force will not be exceeded. Then the process comes to a point when the chip spaces are so large that the highest feeding velocity is obtained when the maximum force is exerted on the sharpening block.

If, after the feeding force has reached its maximal value, the given feeding velocity is maintained, the feeding force is again reduced since the chip spaces would further increase. If a larger chip-chamber-volume is desired the feeding velocity is adjusted to its highest value.

The above described manner of the adjustment could not be realized by known methods and devices because the sharpening rock is not applied to the grinding disk either with the constant force or constant feeding velocity and independently one from another.

According to a still further feature of the invention the objects of the invention are attained by a device for sharpening and scouring a grinding disk having a grinding medium, comprising a sharpening block operated in contact with the grinding disk and drive means connected to the sharpening block for applying the sharpening block to the grinding disk with an adjustable feeding velocity and adjustable feeding force, said drive means including a first drive and a second drive coupled to the first drive, said first drive controlling the feeding velocity of the sharpening block and said second drive controlling the feeding force of the sharpening block so that the adjustable feeding velocity is reduced when the feeding force reaches its maximum allowable value.

The first drive may be a hydraulic cylinder with a hydraulic piston.

The first and the second drive may each include a piston having a piston rod, the piston rods of said first and second drives being mechanically coupled to each other.

According to a modified embodiment of the invention the first drive may be a hydraulic cylinder-piston unit and said second drive is a pneumatic cylinder-piston unit.

The novel features which are considered as characteristic for the invention are set forth in paricular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
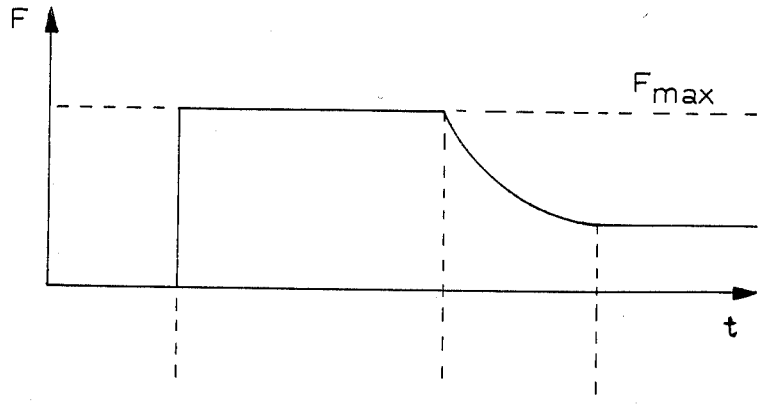
FIG. 1 is a graph illustrating dependence of the feeding force from the feeding velocity.
Figure 2:
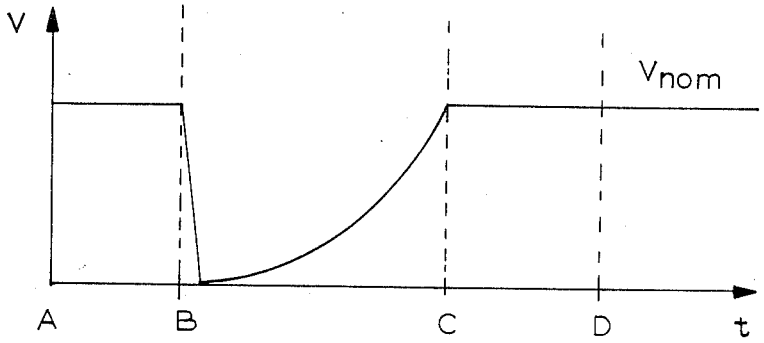
FIG. 2 is a graph showing dependence of the feeding velocity from the time period of sharpening of the grinding disk.

Referring now to the drawings, FIGS. 1 and 2 illustrate ratios between the feeding force, feeding velocity and time period of sharpening, respectively, according to the method of the invention.

As seen in FIG. 1 the feeding velocity V nom is permanently maintained below an adjustable value Fmax of the feeding force. Above this value is the feeding velocity near zero.

The dash line shown in FIG. 1 is a feeding characteristics, which can be realized, for example by a simple damping element and which is disadvantageous with respect to the present invention because it reflects the velocity variations with a feeding force increasing and decreasing below the maximum allowable value Fmax and which leads to the formation of a ship space of the grinding disk, depending on the feeding velocity with the reduced feeding force, which influences the sharpening process.

The characteristics of the velocity/force according to the invention is also shown in FIG. 2 as an optimal possible course of the feeding force and the feeding velocity via the time period of sharpening of the grinding disk.

In order to begin the sharpening process the feeding force is adjusted to its maximum allowable value Fmax. The feeding velocity V has at the beginning of the process a very low value and then rises gradually in accordance with the actual condition of sharpening of the grinding disk from which results a force velocity ratio. As soon as the feeding force exceeds its maximal value will the feeding velocity reach its nominal value Vnom, which will be maintained independently from the further course of the feeding force. The comparison of the results of sharpening have proven that surprising reproducible results are achieved.

In practice the maximum force is adjusted in the first adjusting device and the feeding velocity is adjusted in the second adjusting device. For example, if the feeding velocity is adjusted to 100 mm/min and the force is adjusted to 100 Newton it is possible that the feeding velocity would reach 100 mm. However, if the answer-back signal indicates that the force value is too large and exceeds, for example 100 Newton, then will the feeding velocity be reduced correspondingly so that only the force amounted to 100 Newton would be allowed. The feeding velocity therefore should not only be adjusted from the outside but also automatically in accordance with the value of the available feeding force. On the other hand, the feeding velocity constantly tends to reach its maximal value. This process ends when the ship spaces are so large that, under the given velocity, they take down the material of the rock without further carrying it off. The material is squeezed out from the spaces when the indicated force is declined. The maximum adjustable feeding velocity is also reached when the actually available force decreases to the value which is below the maximum force.

Figure 3:
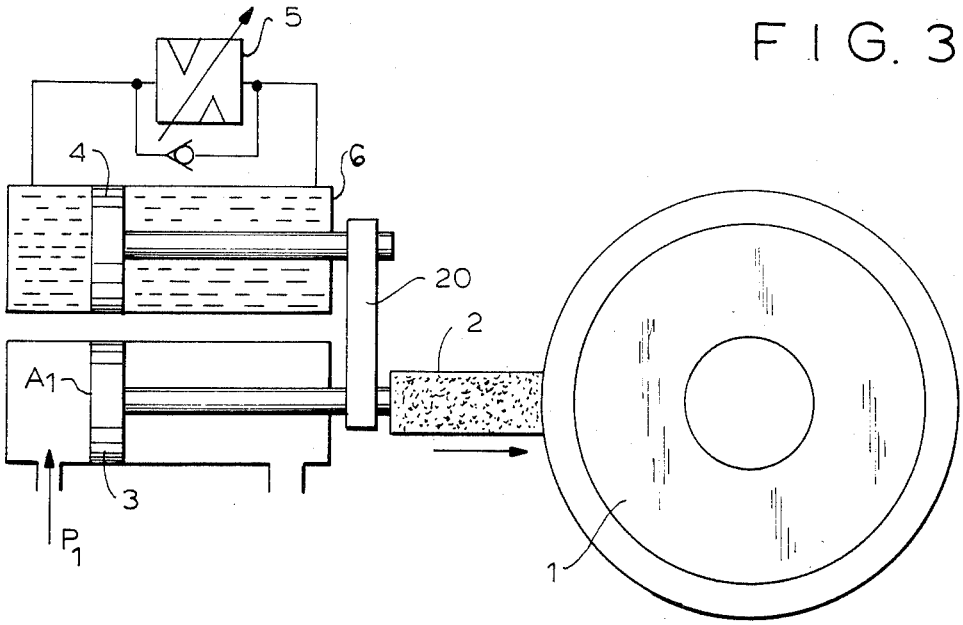
FIG. 3 is a schematic view of the device for sharpening the grinding disk according to the invention.

The device for carrying out the method according to the invention is schematically shown in FIG. 3. A grinding disk 1 is sharpened by a sharpening block 2 which is pressed against the outer surface of the grinding disk by a piston 3 of a pneumatic piston-cylinder drive 10, which piston is in contact with the side surface of block 2. The maximum allowable feeding force results, the value of which depends upon the surface A1 of piston 3 which is under the air pressure P1.

A hydraulic drive generally indicated as 12 includes a cylinder 6 and piston 4 movable therein by a hydraulic oil. Piston 4 is mechanically coupled with piston 3 of the pneumatic drive 10 by a coupling rod 20. Hydraulic cylinder 6 forms with a flow control device or hydraulic rheostat 5 a closed system in which the hydraulic oil, during the feeding movement of the piston, flows from one side of the piston 4 through the flow control device to another side of piston 4. The flow control device 5 provided with a regulating valve 14 adjusts the oil flow independently from the pressure difference between the both sides of the hydraulic piston 4 and therefore independently from the reaction force between the grinding disk and the sharpening block 2 and thus the feeding velocity.

The device according to the invention requires only a very limited space and allows for a very large range of adjustment values whereby an optimal adjustment practically in all operation cases is warranted.

It is advantageous to use the application of the pressure air as an energy carrier because it is always available in many arrangements of the machine tools and causes no connection problems.

The method of sharpening grinding disks according to the invention can be also realized with hydraulic, mechanical, electro-magnetic or magnetic drives in which force and velocity adjusting means, such as spring or damper systems or combined spring-damper systems or flow control systems can be applied.

It will be understood that each of the elements described above, or two or more together, may also find a useful application in other types of methods and devices for sharpening a grinding disk differing from the types described above.

While the invention has been illustrated and described as embodied in a method and device for sharpening a grinding disk, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of sharpening and scouring a grinding disk with a grinding medium such as diamond or cube-crystalline borine nitride by means of a sharpening block operated in contact with the grinding disk, in which the sharpening block is applied to the grinding disk during sharpening with an adjustable feeding velocity and an adjustable feeding force, the method comprising the steps of preliminarily adjusting the feeding velocity of the sharpening block; reducing the feeding velocity when the feeding force reaches its maximum allowable value so that the adjustable maximum force applied to the sharpening block is not exceeded; and continually maintaining the feeding velocity in accordance with a preadjusted nominal value by controlling the feeding velocity as long as the feeding force (F) is below its maximal value (Fmax).

2. A device for sharpening and scouring a grinding disk with a grinding medium, comprising a sharpening block operated in contact with the grinding disk, and drive means connected to the sharpening block for applying the sharpening block to the grinding disk with an adjustable feeding velocity and adjustable feeding force, said drive means including a first drive (12) and a second drive (10) coupled to the first drive, said first drive controlling the feeding velocity of the sharpening block and said second drive controlling the feeding force of the sharpening block so that the adjustable feeding velocity is reduced when the feeding force reaches its maximum allowable value.

3. The device as defined in claim 2, wherein said first drive is a hydraulic cylinder with a hydraulic piston.

4. The device as defined in claim 2, wherein said first and second drive each includes a piston having a piston rod, the piston rods of said first and second drives being mechanically coupled to each other.

5. The device as defined in claim 2, wherein said second drive is a pneumatic cylinder with a pneumatic piston.

6. The device as defined in claim 2, wherein said first drive is a hydraulic cylinder-piston unit and said second drive is a pneumatic cylinder-piston unit.

* * * * *